US005177534A

United States Patent [19]

Kisu et al.

[11] Patent Number: 5,177,534

[45] Date of Patent: Jan. 5, 1993

[54] IMAGE FORMING APPARATUS WITH CONTACT-TYPE CHARGE MEANS

[75] Inventors: Hiroki Kisu, Ichikawa; Hiromichi Yamada, Yokohama, both of Japan

[73] Assignee: Canon Kabushiki Kaisha, Tokyo, Japan

[21] Appl. No.: 620,619

[22] Filed: Dec. 3, 1990

[30] Foreign Application Priority Data

| | | | |
|---|---|---|---|
| Dec. 4, 1989 | [JP] | Japan | 1-314609 |
| Dec. 4, 1989 | [JP] | Japan | 1-314610 |
| Dec. 4, 1989 | [JP] | Japan | 1-314611 |
| Apr. 12, 1990 | [JP] | Japan | 2-097275 |
| Apr. 12, 1990 | [JP] | Japan | 2-097279 |
| Apr. 20, 1990 | [JP] | Japan | 2-104898 |
| Apr. 20, 1990 | [JP] | Japan | 2-104899 |

[51] Int. Cl.[5] ..... G03G 15/02

[52] U.S. Cl. ..... 355/219; 250/325

[58] Field of Search ..... 355/219, 221, 222, 224, 355/225, 226; 250/324, 325, 326; 361/221, 222, 225

[56] References Cited

U.S. PATENT DOCUMENTS

| | | | |
|---|---|---|---|
| 4,627,701 | 12/1986 | Onodo et al. | 250/325 X |
| 4,851,960 | 7/1989 | Nakamura et al. | 361/225 |
| 4,922,299 | 5/1990 | Uchimoto et al. | 355/219 |
| 5,017,965 | 5/1991 | Hashimoto et al. | 355/219 |

*Primary Examiner*—A. T. Grimley
*Assistant Examiner*—Christopher Horgan
*Attorney, Agent, or Firm*—Fitzpatrick, Cella, Harper & Scinto

[57] ABSTRACT

An image forming apparatus includes a movable image bearing member; and a charging device extending in contact with the image bearing member in a direction crossing with a movement direction of the image bearing member, the charging device including a conductive wire extending in the crossing direction.

58 Claims, 16 Drawing Sheets

IMAGE FORMING APPARATUS WITH CONTACT-TYPE CHARGE MEANS

FIELD OF THE INVENTION AND RELATED ART

The present invention relates to an image forming apparatus such as an electrophotographic or electrostatic recording apparatus in the form of a copying machine, a laser beam printer or the like, more particularly to an image forming apparatus having charging means contactable to an image bearing member such as a photosensitive member or a dielectric member to electrically charge (or discharge) it.

As for means for charging the photosensitive member or the dielectric member in an image forming apparatus, a corona discharging device is widely used. It is disposed faced to it and comprises a wire electrode and a shield enclosing the wire electrode. Corona discharging device is an effective means to uniformly charge the member to be charged up to a predetermined potential However, it is disadvantageous in that it requires a high voltage source and a relatively large amount of ozone is produced by corona discharging action.

In place of the corona discharging device, a contactable type charging device is proposed. It comprises a charging member supplied with a voltage and contacted to the member to be charged so as to charge it. It is advantageous in that the required voltage is low and that the amount of produced ozone is very small. It is noted as means in place of the corona discharging apparatus for the purpose of charging the photosensitive member, the dielectric member or another image bearing member or another member to be charged in an image forming apparatus (Japanese Laid-Open Patent Applications Nos. 178267/1979, 104351/1981, 40566/1983, 139156/1983 and 10975/1983).

U.S. Pat. No. 4,851,960 which has been assigned to the assignee of this application proposes a contact type charging method and apparatus in which a vibratory voltage (a voltage level periodically changes) having a peak-to-peak voltage which is not less than twice the charge starting voltage relative to the member to be charged, is applied to the charging member to provide uniform charge.

As for the charging member, it is conventionally in the form of a roller or a blade.

FIG. 10 shows an example of an image bearing member using a contact type chargeable member in the form of a roller to charge the image bearing member. The image forming apparatus is an image transfer type electrophotographic apparatus (copying machine, a laser beam printer or the like).

It comprises an electrophotographic photosensitive member (rigid member) which will hereinafter be called "photosensitive drum", in the form of a drum. It is driven in the clockwise direction at a predetermined peripheral speed (process speed).

A charging roller 2 comprises a conductive core metal 2*a* made of iron, stainless steel (SUS) or the like and a conductive rubber layer 2*b* made of EPDM or the like containing carbon and covering the outer periphery thereof. The roller 2 is contacted to the surface of the photosensitive drum 1 by urging the core metal 2*a* adjacent the opposite longitudinal ends thereof by an urging means not shown such as spring, and it rotates following the rotation of the photosensitive drum 1 in this example.

An external voltage source 9 supplies voltage to the charging roller 2. It applies to the charging roller 2 a vibratory voltage provided by a predetermined DC voltage superposed with an AC voltage having a peak-to-peak voltage which is not less than twice the charge starting voltage relative to the photosensitive member, through a contact spring 8 and a core metal 2*a* . The outer periphery of the photosensitive drum 1 rotated is charged to a predetermined potential.

Then, the charged photosensitive member is exposed to image light by charging means 3. The image light is image light of an original or a scanning laser beam imagewisely modulated, so that an electrostatic latent image is sequentially formed on the photosensitive member in accordance with the intended image information.

Subsequently, a developing device supplied toner to the surface of the photosensitive drum 1 from a developing sleeve 4 to develop the latent image into a toner image on the photosensitive drum 1.

An image transfer roller 5 is press-contacted to the photosensitive drum 1 at a position downstream of the developing sleeve 4 in the rotational direction of the photosensitive drum. A transfer material 7 is fed from an unshown sheet feeder to a nip (transfer position) between the photosensitive drum 1 and the transfer roller 5. It is supplied at such a timing that when the leading edge of the toner image on the photosensitive drum 1 reaches the nip, a leading edge of the transfer material 7 reaches the nip. To the transfer roller 5 a transfer bias is applied from voltage source, so that the toner image is transferred from the photosensitive drum 1 surface to the transfer material 7 gradually in the process of the transfer material 7 passing through the nip.

The surface of the photosensitive drum 1 after the toner image transfer is cleaned by a cleaning device 6 so that the residual toner or the like is removed, and therefore, is prepared for the repeated image formation.

FIG. 11 shows another example of the charging member 20 in the form of a blade rather than the charging roller 2 (FIG. 10) It comprises a conductive core 20*a* and a conductive rubber blade 20*b*. The charging blade 20 is contacted to the surface of the photosensitive drum 1 co-directionally or counter-directionally. A voltage is applied to the core plate 20*a* to charge the photosensitive drum 1 surface.

The system using the charging roller or the charging blade involves the following problems.

(1) Where the surface of the charging member is rubber directly contacted to the photosensitive drum (image bearing member), and when the charging roller or the blade is press-contacted to the photosensitive drum for a long period of time, the plasticizer of the rubber oozes out from the rubber layer and is deposited on the photosensitive drum surface with the result of flowing image.

(2) The size of the transfer material is large as in the case of A3 size, the length of the charging roller becomes large. When the charging roller is urged to the photosensitive drum by pressing means at the opposite ends, the central portion thereof may be out of contact from the surface of the photosensitive drum, with the result of improper charging.

(3) With the increase of the process speed, the frequency of the primary voltage source supplied to the charging roller or the blade is required to be increased in order to prevent non-uniform charging. If the frequency is increased, the vibration of the photosensitive drum, charging roller or the blade is produced with the result of larger noise.

(4) In an image forming apparatus which is recently required to be reduced in the size, the size of the photosensitive drum and the size of the charging means are desired to be further reduced.

SUMMARY OF THE INVENTION

Accordingly, it is a principal object of the present invention to provide an image forming apparatus wherein the possible production of flow of image attributable to the foreign matter oozed from the charging means and deposited on the image bearing member, is prevented.

It is another object of the present invention to provide an image forming apparatus wherein the improper charging is prevented by improving contact between the image bearing member and the charging means.

It is a further object of the present invention to provide an image forming apparatus wherein charging noise is reduced.

It is a further object of the present invention to provide an image forming apparatus having a small size and low cost charging means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a top plan view of the charging device of FIG. 2.

DESCRIPTION OF THE PREFERRED EMBODIMENTS

The preferred embodiments of the present invention will be described.

Figure 10:
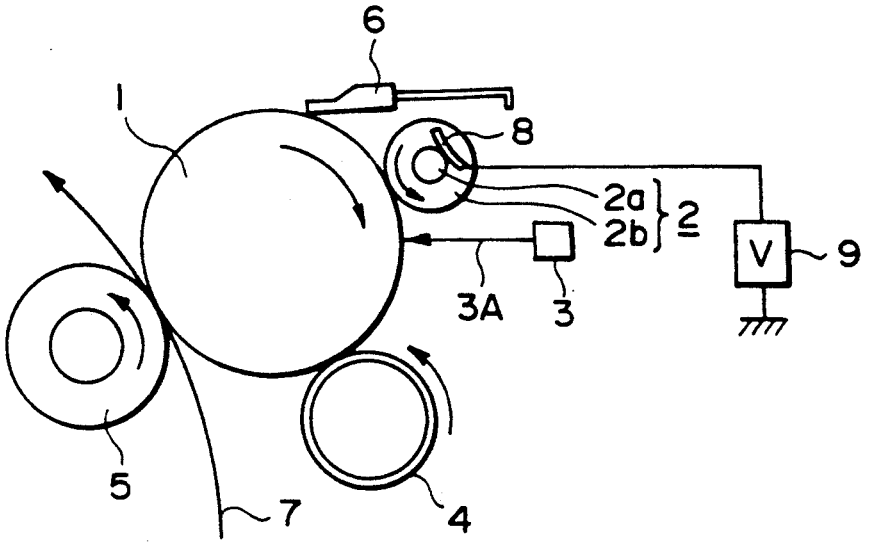
FIGS. 10 and 11 are side views of conventional image forming apparatus.
Figure 11:
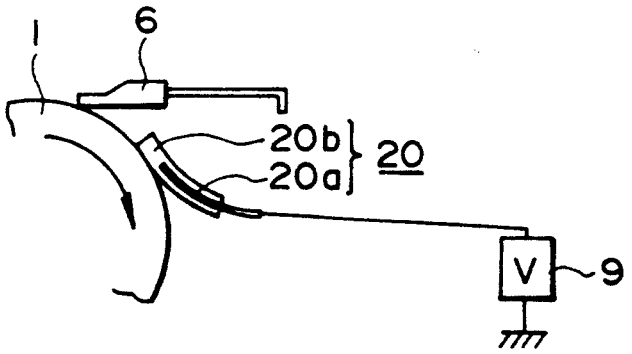
Figure 12:
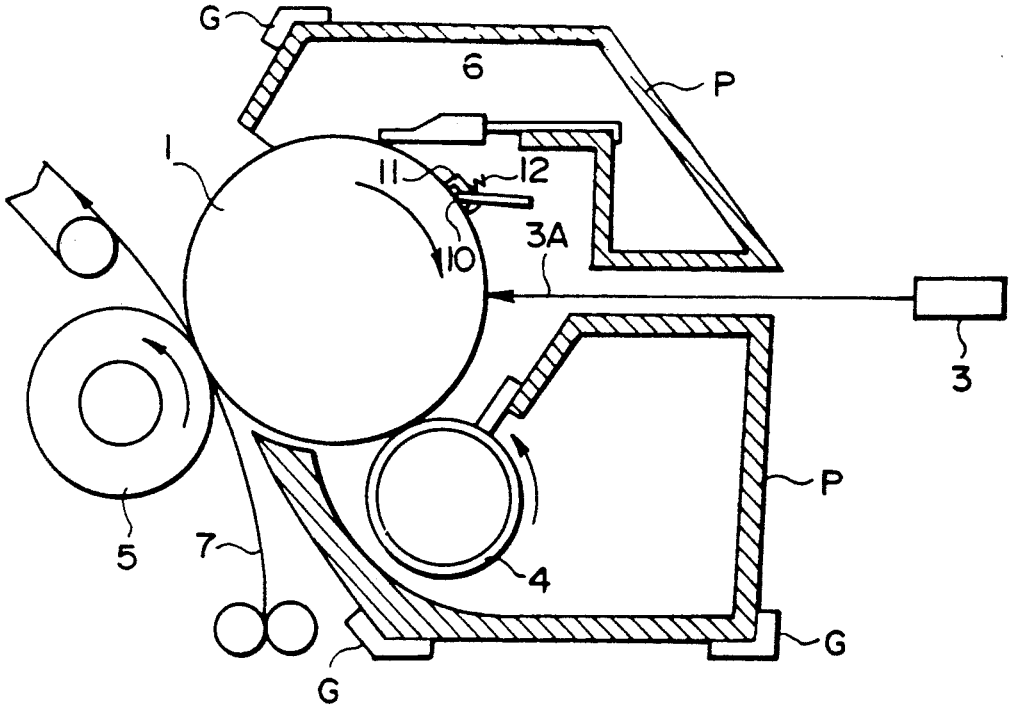
FIG. 12 is a side view of an image forming apparatus according to another embodiment of the present invention.

Referring to FIG. 12, there is shown an image forming apparatus according to an embodiment of the present invention. In this Figure, the same reference numerals as in FIG. 10 are assigned to the elements having the corresponding functions, and the detailed description therefor is omitted.

The photosensitive drum 1 (image bearing member), charging means 10, 11 and 12 for the photosensitive drum 1, the cleaning device and the developing device are supported on a frame P (hatched portion) of a process unit. The frame of the process unit P is detachably mountable to a main assembly of the image forming apparatus along a guide G in a direction perpendicular to the sheet of the drawing. The process unit P may contain at least one of the photosensitive drum 1 and the charging device 10, 11 or 12.

Figure 1:
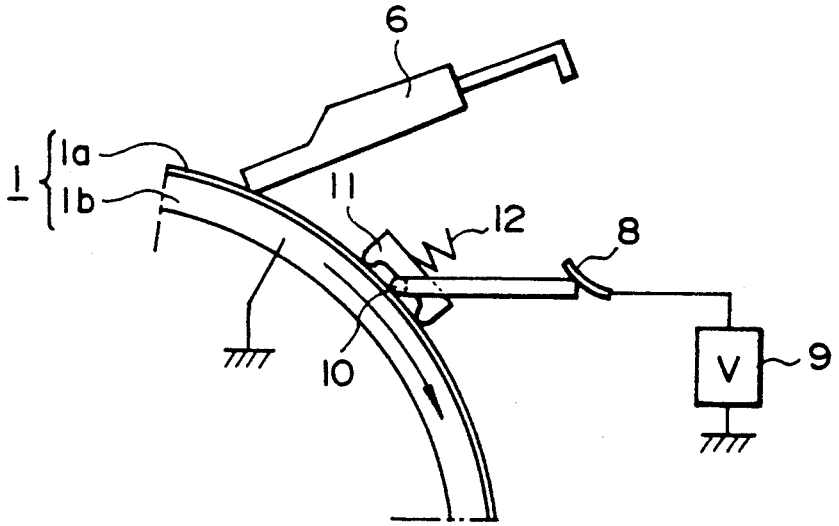
FIG. 1 is a side view of a charging device usable with an image forming apparatus according to an embodiment of the present invention.

FIG. 1 shows an enlarged view of the charging device used in the image forming apparatus of FIG. 12.

Figure 2:
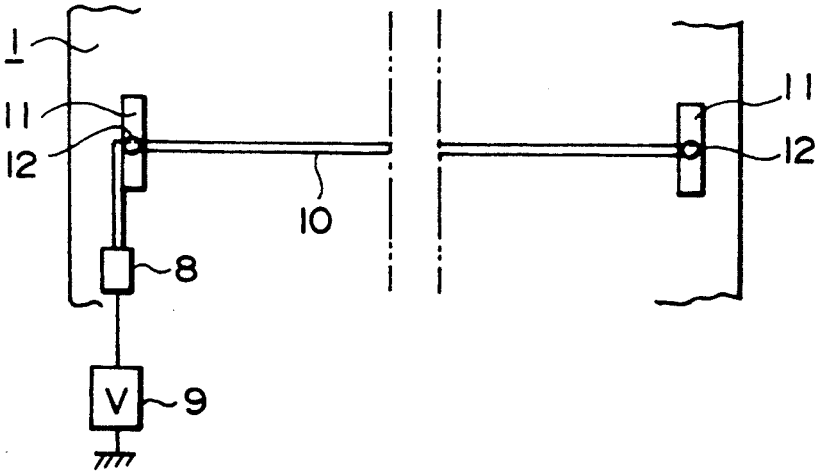
Figure 3:
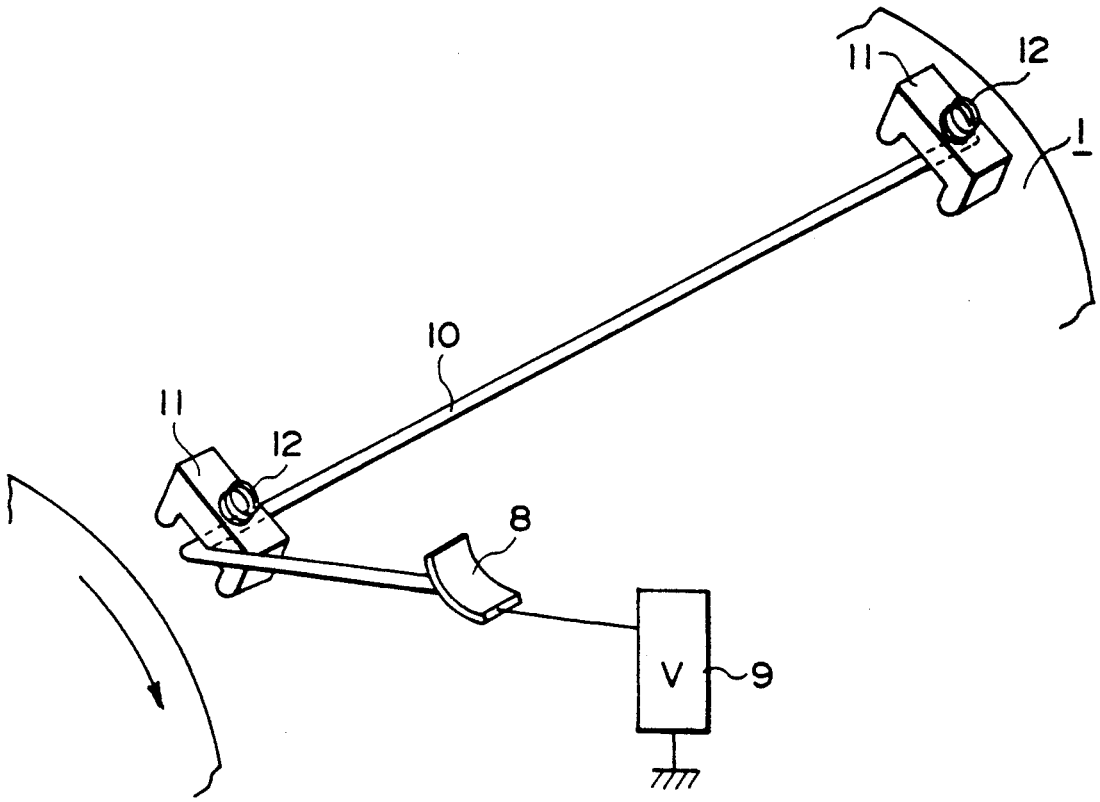
FIG. 3 is a perspective view of the charging device of FIG. 1.

Referring to FIG. 1, FIGS. 2 and 3, the description will be made as to a contactable wire type charging device.

FIGS. 2 and 3 are top plan view and a perspective view of the charging device of FIG. 1.

A photosensitive drum 1 is a member to be charged and comprises a drum base 1*b* of aluminum and a photosensitive layer 1*a* thereon made of organic photoconductive (OPC) in this embodiment. It has an outer diameter of 30 mm in this embodiment. It is rotated in the clockwise direction at a predetermined speed.

A charging wire 10 functions as a contact type charging member and is made of conductive wire of iron, copper, aluminum, stainless steel or the like. Urging members 11 and 11 adjacent the opposite longitudinal ends thereof press-contact the charging wire to the photosensitive drum 1 surface. The charging wire is made of polyacetal (DERLIN, available from DuPont) and extends parallel with a generating line of the drum. The charging wire 10 is made of tungsten plated with gold and has an outer diameter of 60 microns in this embodiment.

Springs ,12 and 12 normally urge the urging members 11 and 11 toward the photosensitive drum 1. The charging wire between the urging members 11 and 11 extends in a direction crossing with the movement direction of the photosensitive drum 1, and press-contacted to the surface of the photosensitive drum 1 covering an effective charging width of the photosensitive drum 1.

To the charging wire 10, a voltage is applied from the voltage source 9 through a contact 8, by which a vibratory voltage in the form of a DC biased AC voltage is applied thereto so that a charging electric field is formed between the wire 10 and the drum 1, so that a voltage having a periodically changing voltage level is applied. Preferably, the vibratory voltage has a peak-to-peak voltage which is not less than twice a charge starting voltage between the wire 10 and the photosensitive member 1. Then, between the wire 10 and the drum 1, a vibratory voltage is sufficient to effect transfer and transfer-back of the electric charge. The waveform of the vibratory voltage may be sine rectangular, triangular or pulse-like. The charging is possible using the DC voltage only.

With this structure, the photosensitive drum is rotated at a peripheral speed of 40 mm/sec, and the charging wire 10 is supplied with a DC voltage component of −700 V and with an AC voltage component having a peak-to-peak voltage of 1800 Vpp and a frequency of 250 Hz, from the voltage source 9. It has been confirmed that the surface of the photosensitive member 1*a* is uniformly charged approximately to −700 V, and good image is produced.

As described hereinbefore, it is desirable that the peak-to-peak voltage of the AC component or the vibratory voltage is not less than twice the charge starting voltage which is the voltage at which the charging of the member to be charged starts when only a DC voltage is applied to the charging member, since then the member is uniformly charged. In this embodiment, the charge starting voltage with the DC voltage only was −500 V, and therefore, the peak-to-peak voltage providing the uniformity was approximately 1100 Vpp.

It has been confirmed that there is no flow of the image attributable to the plasticizer oozed from the conductive rubber in the case of the conventional charging roller or the charging blade, the local improper charging by the non-contact between the charging member and the photosensitive member, or significant charging noise.

Figure 6:
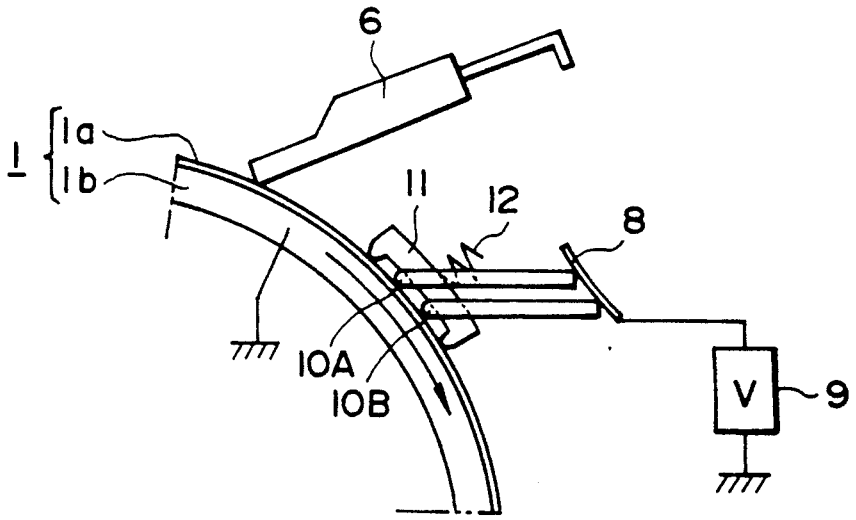
Figure 7:
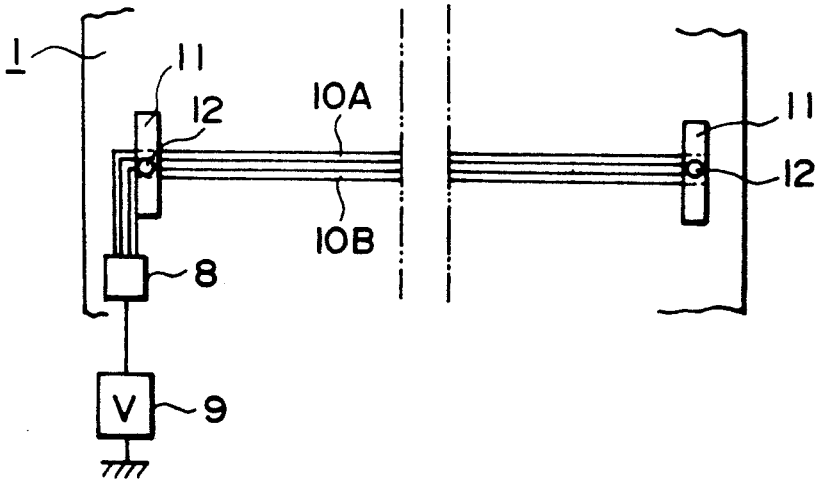
FIG. 7 is a top plan view of the charging device of FIG. 6.
Figure 8:
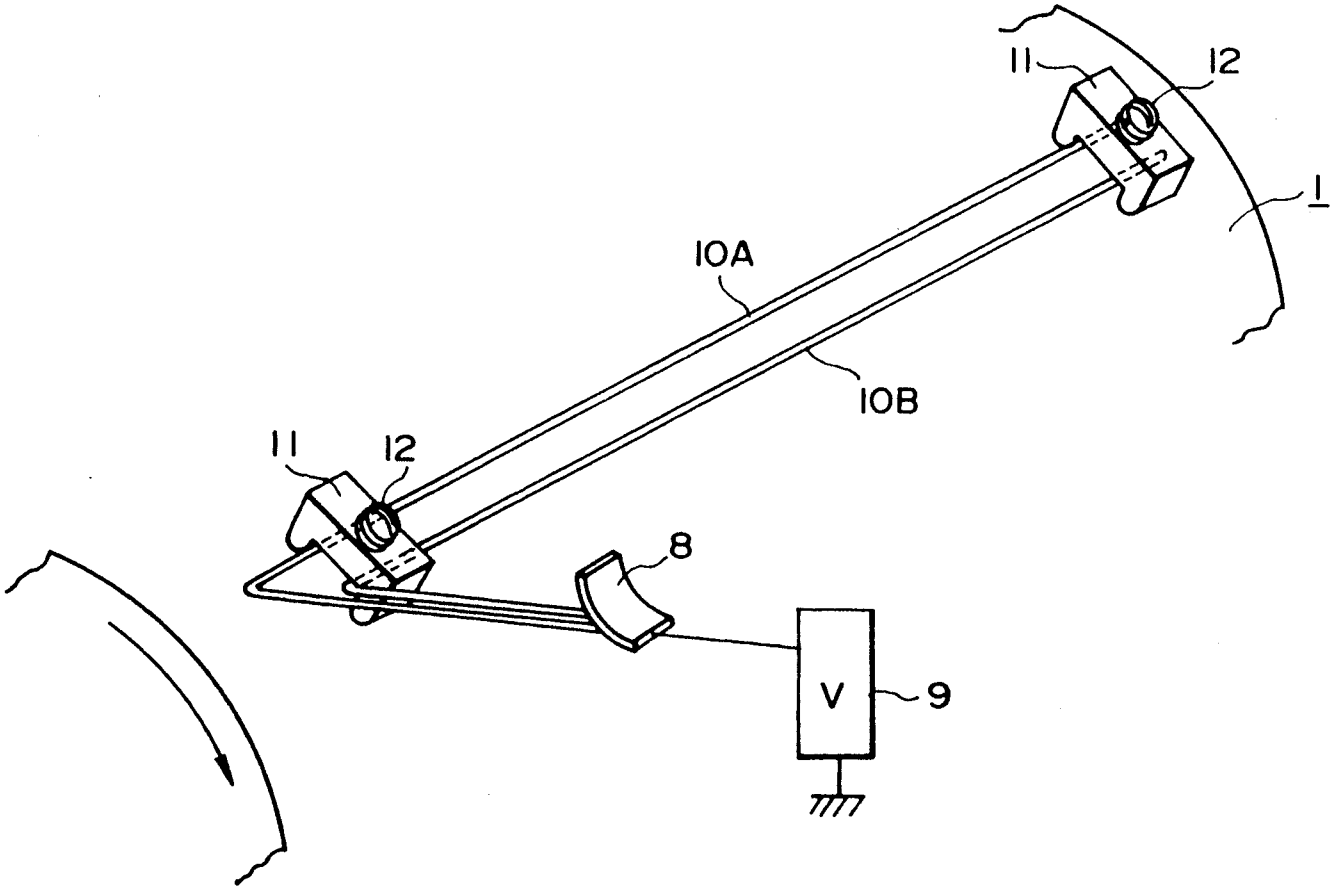
FIG. 8 is a perspective view of the charging device of FIG. 6.

Referring to FIGS. 6, 7 and 8, a charging device according to another embodiment of the present invention will be described. FIGS. 7 and 8 are a top plan view and a perspective view of the charging device of FIG. 6. In this embodiment, two charging wires are used. The two charging wires 10A and 10B are extended parallel with each other and are press-contacted to the surface of the photosensitive drum 1 by urging members 11 and 11. They are supplied with voltages. Even if foreign matter is deposited on one of the charging wires, or even if one of them is broken, the charging operation can be kept by the remaining charging wire. The number may be three or more.

Figure 4:
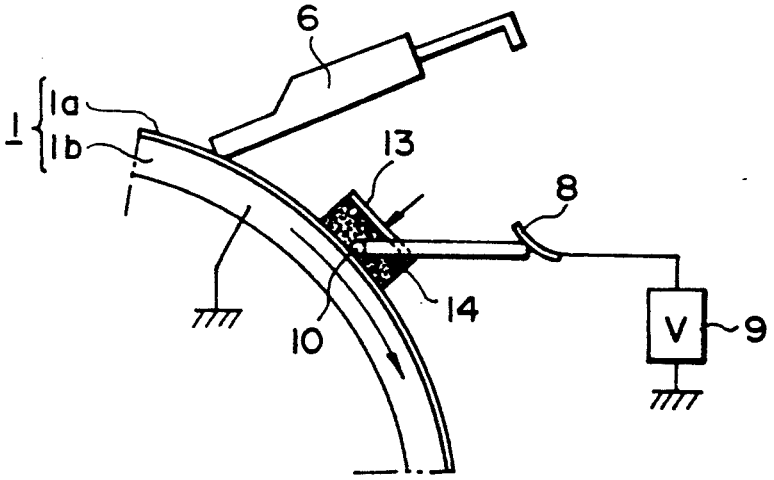
FIGS. 4, 6, 14, 16, 17, 25, 26, 27, 29A and 29B are side views of charging devices according to other embodiments.
Figure 5A:
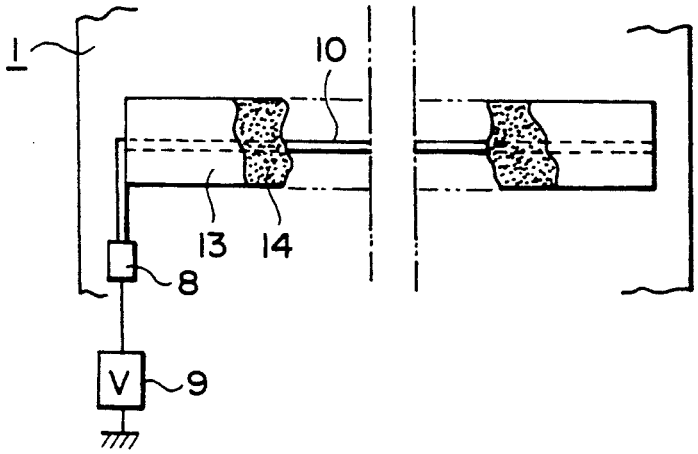
FIG. 5A is a top plan view of the charging device of FIG. 4.
Figure 5B:
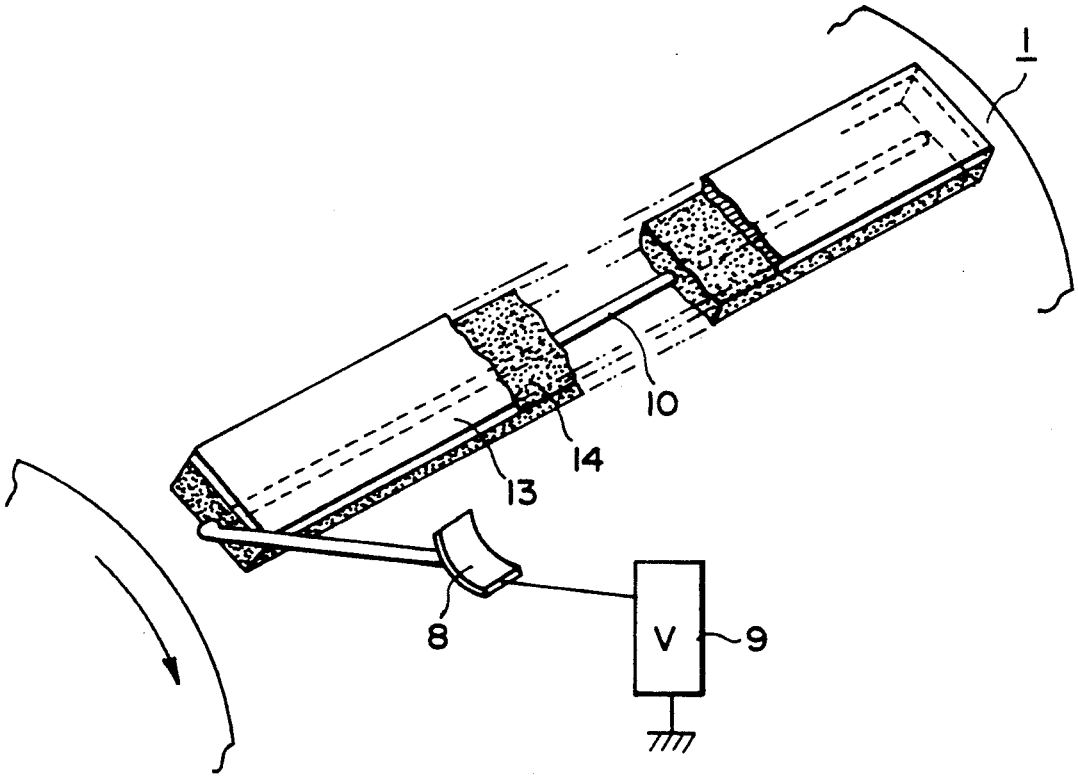
FIG. 5B is a perspective view of the charging device of FIG. 4.

Referring to FIGS. 4 and 5, a charging device according to a further embodiment of the present invention will be described, in which the non-contact between the charging wire and the photosensitive drum is prevented. FIG. 4 is a side view of the charging device, and FIG. 5 is a partly broken-away top plan view. In this embodiment, the charging wire 10 is urged to the photosensitive drum surface 1 by an elastic member 14 which is made of MOLTOPREN (AVAILABLE from INOAC Kabushiki Kaisha, Japan) or the like and which is long enough to cover the entire length of the wire 10, by which the urged state is maintained over the entire length of the charging wire. The elastic member 14 has an elongated rigid holder plate 13 at a side opposite from the side of the wire urged to the photosensitive member. The holder plate 13 is made of DERLIN or the like. The holder plate 13 is urged by an unshown pressing member toward the photosensitive drum 1 with the elastic member 14 sandwiched between the holder plate 13 and the surface of the photosensitive drum 1 against the elastic force thereof, by which the entire length of the charging wire 10 is stably and uniformly pressed to the photosensitive drum 1, thus establishing the cross contact therebetween. Therefore, even if the charging wire 10 is supplied from the external voltage source 9 with the vibratory voltage having a large peak-to-peak voltage, the vibration of the charging wire 10 is not significant, as contacted to the case of FIGS. 1–3.

Even if a DC voltage only is supplied to the charging wire, the charging wire 10 does not dance upon the application thereof. As a result, the charging wire 10 is maintained in contact with the photosensitive drum 1 surface, so that the stabilized charging is possible. When the unevenness of the photosensitive drum surface 1 is large, this is particularly effective. In addition, as contrasted to the conventional charging blade, the silica particles and toner particles passed under the cleaning blade 6 are collected by the elastic members 14, and therefore, the charging wire 10 is not contaminated.

Figure 13:
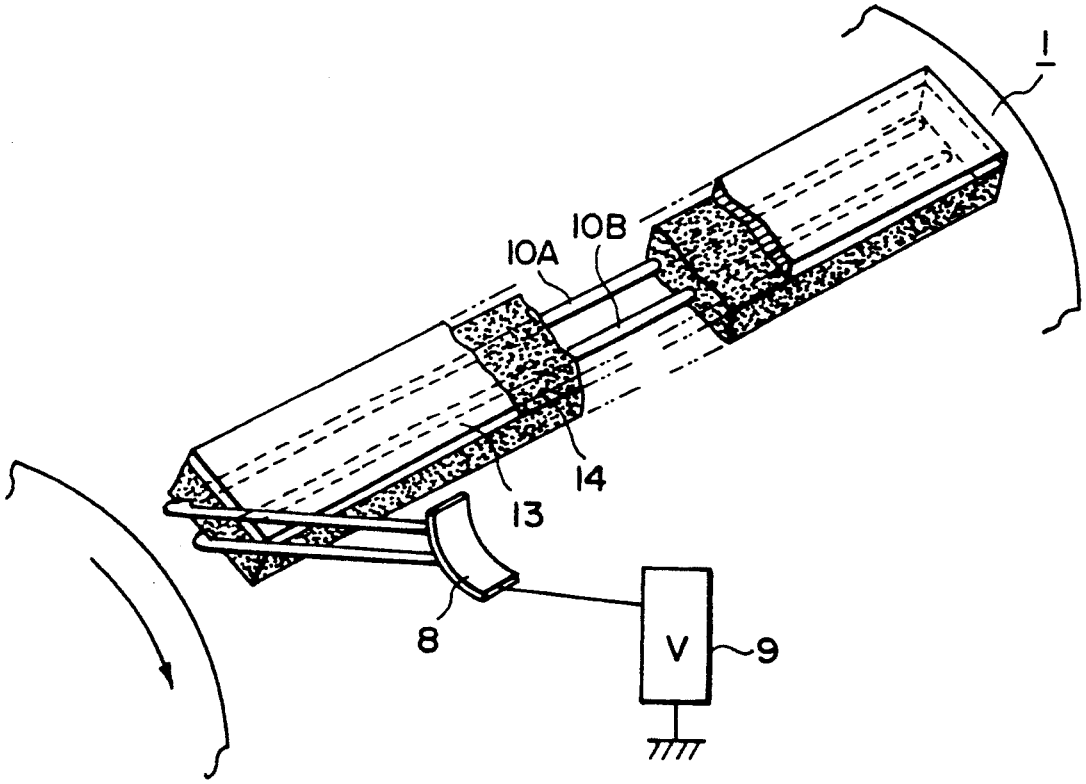
FIG. 13 is a perspective view of a charging device according to a further embodiment of the present invention.

As shown in FIG. 13, two or more charging wires 10 may be used, similarly to the cases of FIGS. 6, 7 and 8.

Figure 14:
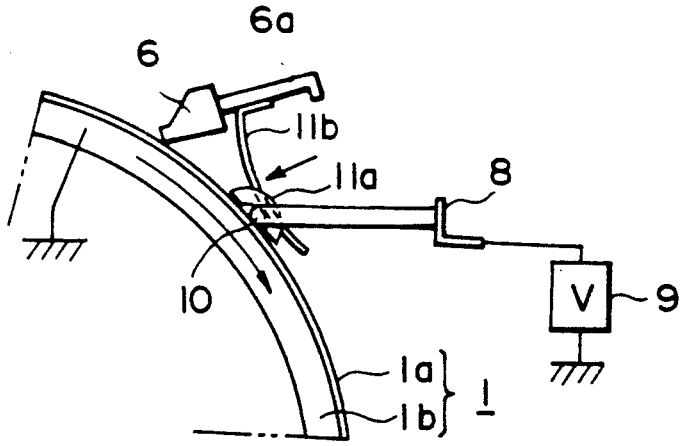
Figure 15:
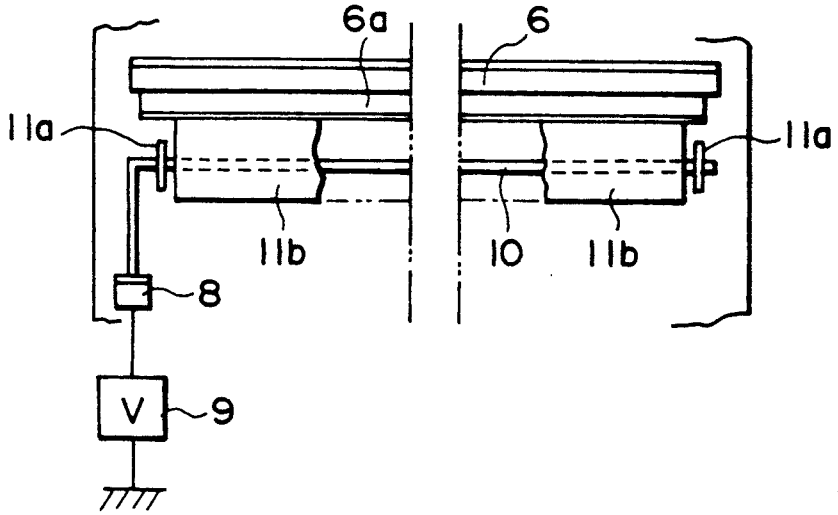
FIG. 15 is a top plan view of the charging device of FIG. 14.

FIGS. 14 and 15 show a further embodiment of the charging device. In this embodiment, the charging wire 10 is made parallel to the generating line of the drum, and the opposite ends thereof are confined by urging members 11*a* and 11*a* made or DERLIN or the like. The portion of the charging wire between the confining members 11*a* and 11*a* is contacted to the surface of the photosensitive drum 1 by a resilient force of an urging sheet 11*b* which is made of polyethylene terephthalate (Myler (trade name)) having a thickness of 100 microns, and which is fixed on a cleaning blade holder 6*a* at one of its long sides.

With this structure, the charging operation is stabilized, and the urging member 11*b* is not directly contacted to the photosensitive drum 1, and therefore, the photosensitive drum is not scraped by the urging member. Other materials of the urging member 11*b* include stainless steel, aluminum, PET, copper sheet or the like.

Figure 16:
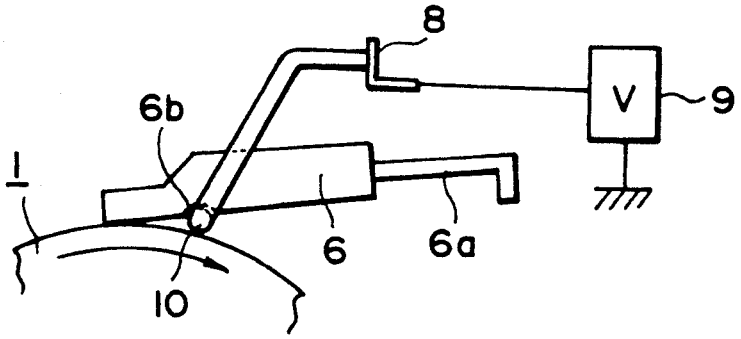

FIG. 16 shows a further embodiment of the charging device. In this embodiment, the cleaning blade 6 is used as the urging member for the charging wire 10.

A backside of the cleaning blade 6 is provided with a positioning groove 6*b* for accommodating the charging wire 10. The groove 6*b* extends in the longitudinal direction of the blade 6, that is, in the direction of the generating line of the photosensitive drum. The charging wire 10 is in the groove 6*b* and is bonded by a bonding agent if necessary. The edge of the cleaning blade 6 is press-contacted to the photosensitive drum 1 surface, and the charging wire 10 at the backside of the blade 6 is urged to the surface of the photosensitive drum 1. With this state, the cleaning blade is fixedly mounted on an unshown mounting member. With this structure, no additional member is required to urge the charging wire 10, and the structure around the photosensitive drum is very simple.

Figure 17:
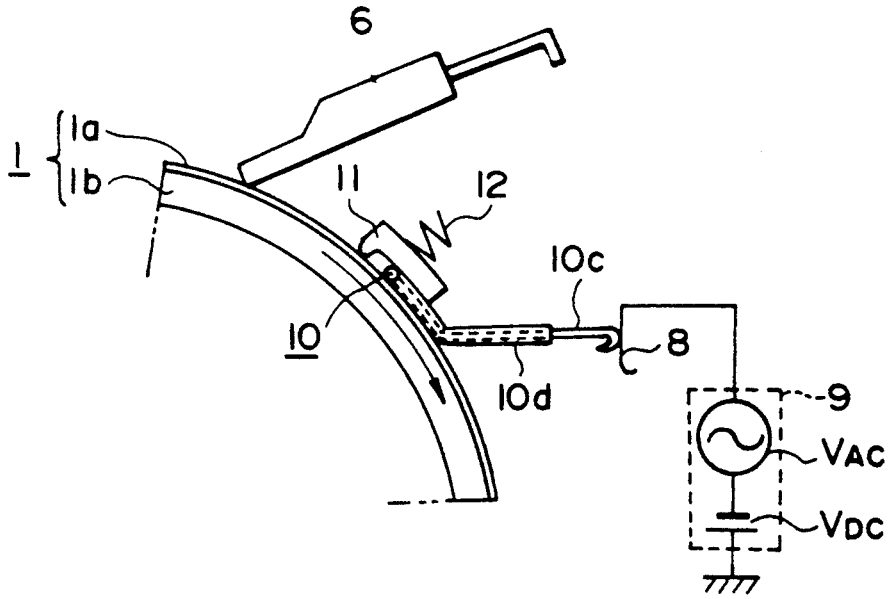
Figure 18:
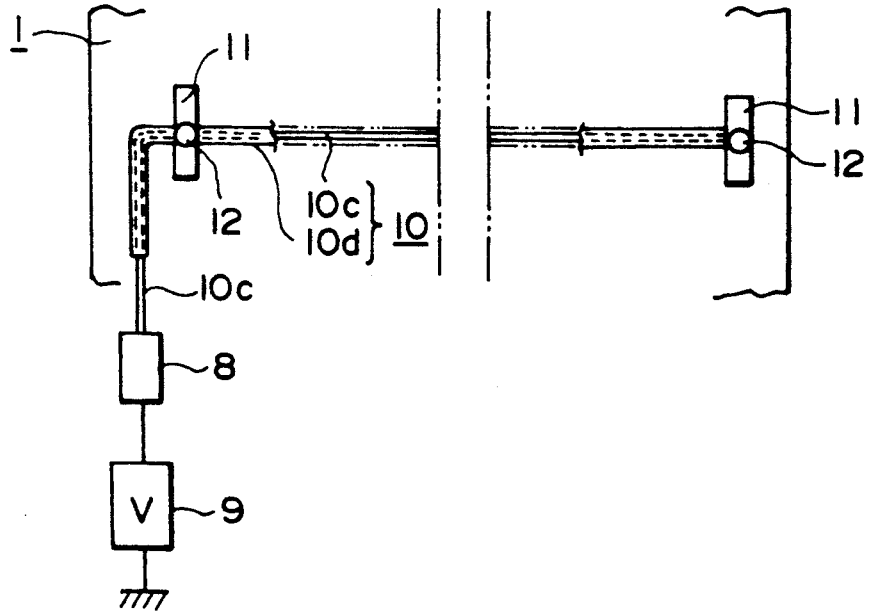
FIG. 18 is a top plan view of a charging device of FIG. 17.
Figure 19:
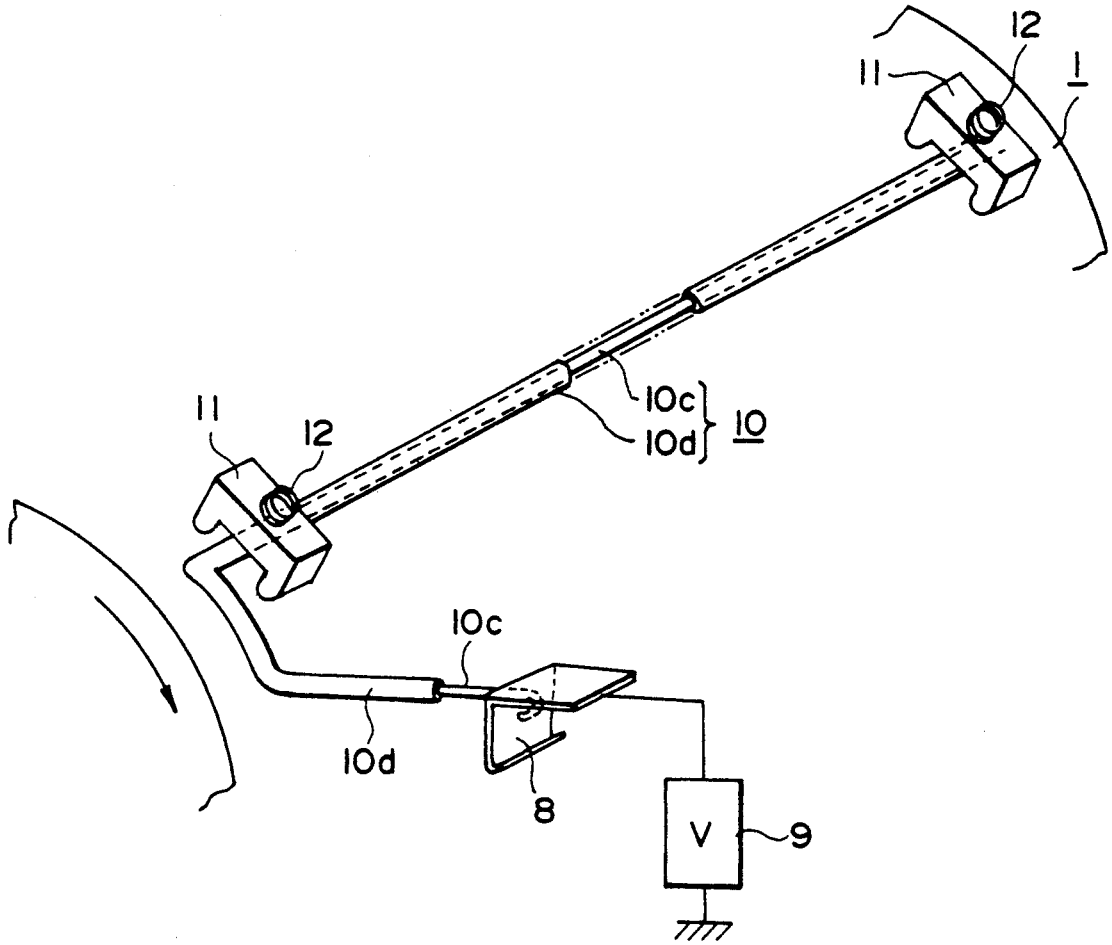
FIG. 19 is a perspective view of a charging device of FIG. 17.

FIGS. 17–19 show a further embodiment of the charging device. The charging wire 10 functioning as the contactable charging member has a core metal 10*c* made of tungsten and having a diameter of 60 microns and a coating of N-methoxymethyl nylon (Tresin, available from Teikoku Kagaku Sangyo Kabushiki Kaisha) having a thickness of 10 microns as a resin surface layer 10*d*. The core metal 10*c* may be of a conductive wire made of iron, copper, aluminum, stainless steel or the like.

In order to enhance the bonding strength between the surface layer 10*d* and the metal core 10*c*, one or more primer layer may be used. The volume resistivity of the primer layer or layers are not required to be smaller than that of the surface layer 10*d*, but the film thickness may be selected within such a range that the contact type charging wire 10 is capable of charging the photosensitive drum 1.

Figure 20:
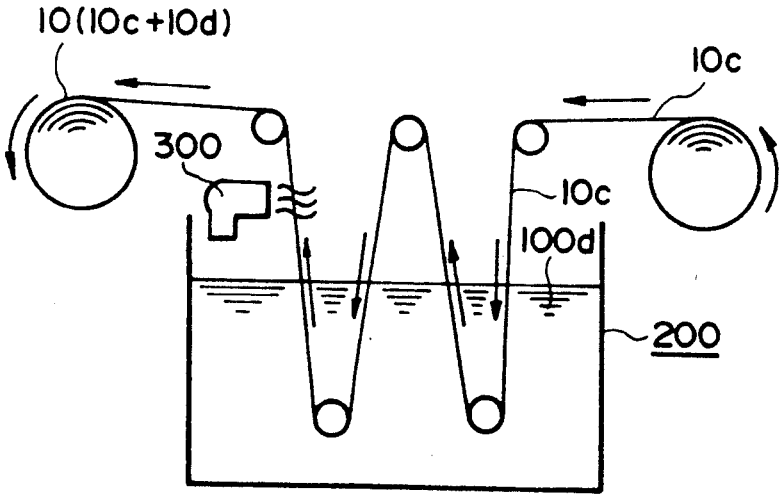
FIG. 20 is a side view of a surface coating device for the charging wire.

The resin coated charging wire 10 is produced in the following manner. First, n-methoxymethyl nylon is solved in a solvent such as a mixture of methanol and toluene to produce n-methoxymethyl nylon resin liquid. The liquid 100*d* is contained in a container 200 as shown in FIG. 20. The core metal 10*c* of tungsten wire is repeatedly dipped thereinto to form the resin layer 10*d* on the surface of the tungsten wire. The moving speed and the drying period of the tungsten wire 10*c* are so determined that the thickness of the resin layer 10*d* is 1-1000 microns. Designated by a reference numeral 300 is a drier.

The charging wire 10 thus produced is extended substantially in parallel with the drum generating line in contact with the surface of the photosensitive drum 1 by the urging members 11 and 11 made of DERLIN or the like. The urging member 11 and 11 are urged by the springs 12 to normally urge the wire to the drum. The charging wire 10 between the urging members 11 and 11 is press-contacted to the surface of the photosensitive drum 1.

To the core metal 10*c* of the charging wire 10, a vibratory voltage which is an AC biased DC voltage is supplied from the voltage source through the contact 8. By the application of the vibratory voltage, the voltage level applied to the charging wire 10 periodically changes. More particularly, the peak-to-peak voltage of the vibratory voltage is not less than twice the charge starting voltage relative to the photosensitive member. The vibratory voltage has a sine, rectangular, triangular and pulse waveform. The member to be charged can be charged by the DC voltage only.

Since the core metal 10*c* of the charging wire 10 is made of tungsten, the electric resistance is substantially 0 ohm, and the electric resistance of the surface layer 10*d* is approximately 30M-ohm, and the electrostatic capacity thereof is approximately 1700 pF. Therefore, the reactance (capacitance)$=\frac{1}{2}\pi fC$ is approximately 0.4M-ohm when the core metal 10*c* is supplied with an DC bias voltage of 250 Hz. Since the resistance of the core metal 10*c* of the charging wire 10 is negligibly small as compared with the resistance of the surface layer 10*d*, the resistance of the charging wire 10 is substantially equal to the resistance of the surface layer 10*d*.

The resistance and the electrostatic capacitance of the charging wire 10 is determined in the following manner. The charging wire is pressed to the drum made of aluminum, and a resistance measuring device and an electrostatic capacitance measuring device are connected between the core metal 10*c* and the aluminum drum. The obtained values are converted to the values per 1 $cm^2$. The electrostatic capacitance per 1 $cm^2$ of the photosensitive drum (the member to be charged) is approximately 140 pF.

Figure 24:
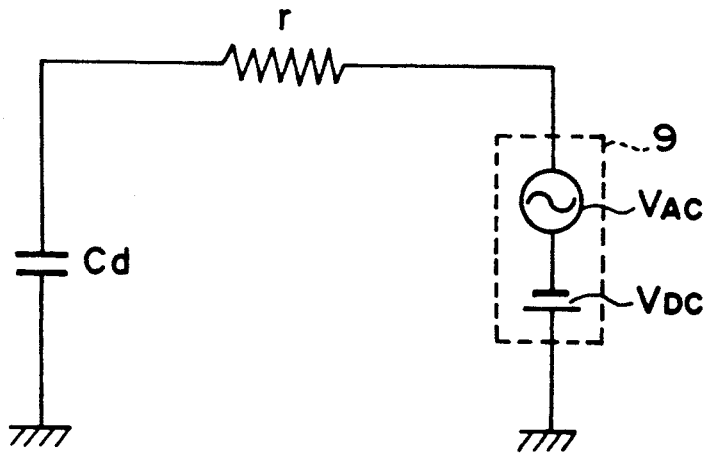
FIG. 24 is a circuit equivalent to the case wherein the charging wire comprising only the core metal.

FIG. 24 shows an equivalent circuit of the charging device. Since, $$R > \frac{1}{2}\pi fC,$$

$$C > Cd$$

The AC voltage VAC can be applied to the photosensitive drum substantially without loss, where R is a resistance of the charging wire; f is a frequency of the applied bias voltage; c is an electrostatic capacitance of the charging wire; and Cd is the electrostatic capacitance of the photosensitive drum.

In the above inequations, the difference by one order is sufficient. Since the resistance R of the surface layer 10*d* of the charging wire is sufficiently large, a pin hole of the photosensitive drum if any does not result in leakage of the current between the charging wire and the pin hole. Therefore, the voltage drop of the power supply system can be prevented.

The resistance R of the charging wire 10 is $$8.51\times10^{2}\text{ohm} \leqq R \leqq 2.20\times10^{12}\text{ohm}.$$

The former part of the inequation is the requirement for the prevention of the leakage and the latter part thereof is the requirement for the prevention of improper charging.

The electrostatic capacitance C of the charging wire 10 is $$1\text{ pF} \leqq C \leqq 100\text{ nF}.$$

The electrostatic capacitance Cd of the photosensitive drum 1 (the member to be charged)

$$0.1\text{ pF} \leqq Cd \leqq 10\text{ nF}.$$

Using the above-described structure, the photosensitive drum 1 was rotated at a peripheral speed of 40 mm/sec. To the core metal 10*c* of the charging wire 10, a vibratory voltage having a DC component of −700 V and an AC component having a peak-to-peak voltage of 1800 Vpp and a frequency of 250 Hz, was applied from the power source 9. Then, the surface of the photosensitive member 1A was uniformly charged to approximately −700 V. Good images were produced without problem attributable to the pin hole.

The present invention is particularly advantageous when the peak-to-peak voltage of the AC component is not less than twice the charging starting voltage which is the voltage at which the charging of the member to be charged starts upon application only of the DC voltage, since then the charging becomes uniform. In this embodiment, the charge starting voltage was −560 V when the DC voltage only was applied.

Here, it is assumed that the resistance of the charging wire 10 with the surface layer 10*b* relative t the photosensitive drum 1 is R1, the volume resistivity of the core metal 10*a* is $\pi$1, the volume resistivity of the surface layer 10*b* is $\pi$2, the radius of the core metal 10*a* is r1, the radius of the contact charging wire 10 is r2, the (effective) length of the charging wire 10 is L, and the nip width is d(=2×r2).

Since the core metal 10*a* of the charging wire 10 is made of iron., the volume resistivity P1 is $$9.41\times10^{-8}\text{ ohm.cm}$$

and therefore, it is substantially zero. Therefore, $$R1 = (\pi 2 \times \ln r2/r1)/Ld$$

The volume resistivity $\pi 2$ has been confirmed to be preferably $10^5$ ohm.cm$-10^{12}$ ohm.cm in order to provide good charging operation.

As described in the foregoing, according to this embodiment, at least the contact portion of the conductive base of the contactable charging wire with the member to be charged is coated with at least one resistance layer, and the volume resistivity of the outermost layer of the charging member is made larger than the volume resistivity of the base of the charging wire. Therefore, even if the member to be charged has a pin hole, the voltage drop of the power supply system attributable to the current leakage can be prevented, and therefore, the improper charging of the entire range where the charging member is in contact with the member to be charged, can be prevented.

The contactable charging wire may be a bare metal wire without coating. However, if, for example, a pin hole is produced in the surface of the photosensitive drum (the member to be charged) in the image forming apparatus for some reason or another (shot by foreign matter or introduction thereof, for example), the current leakage occurs between the charging wire and the pin hole of the photosensitive drum with the result of significant voltage drop of the power supply system, when the pin hole comes to the charging wire. Therefore, if the leakage occurs, the improper charging occurs in the entire longitudinal range contacting the photosensitive drum. In the actual image, it becomes a black stripe in the case of a reverse development, and it becomes a white stripe in the case of a regular development. The black or white stripe appears repeatedly with the period of the rotation of the photosensitive drum, and therefore, the image quality is significantly degraded.

Figure 21:
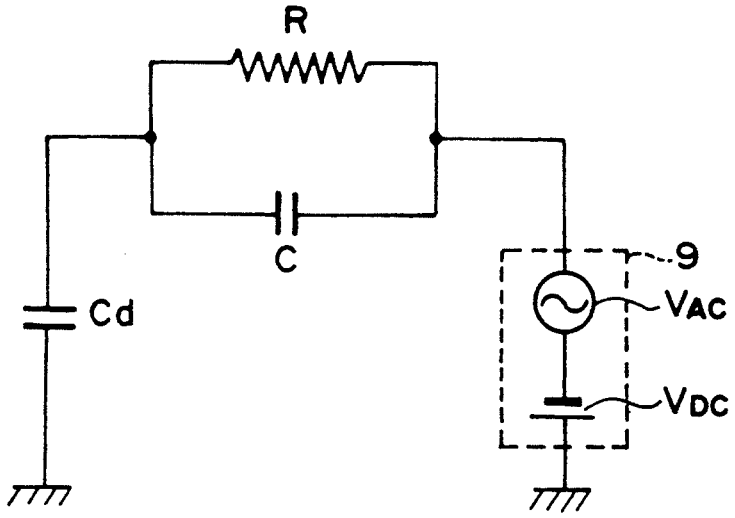
FIG. 21 is a circuit diagram which is equivalent to the charging device of FIG. 17.
Figure 22:
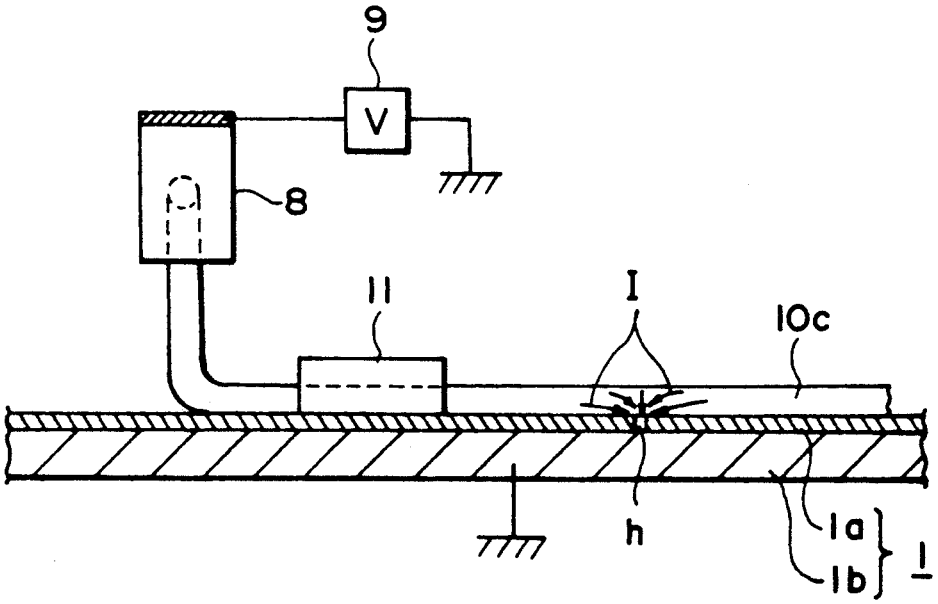
FIGS. 22 and 23 illustrates leakage of current at a pin hole of the photosensitive member.
Figure 23:
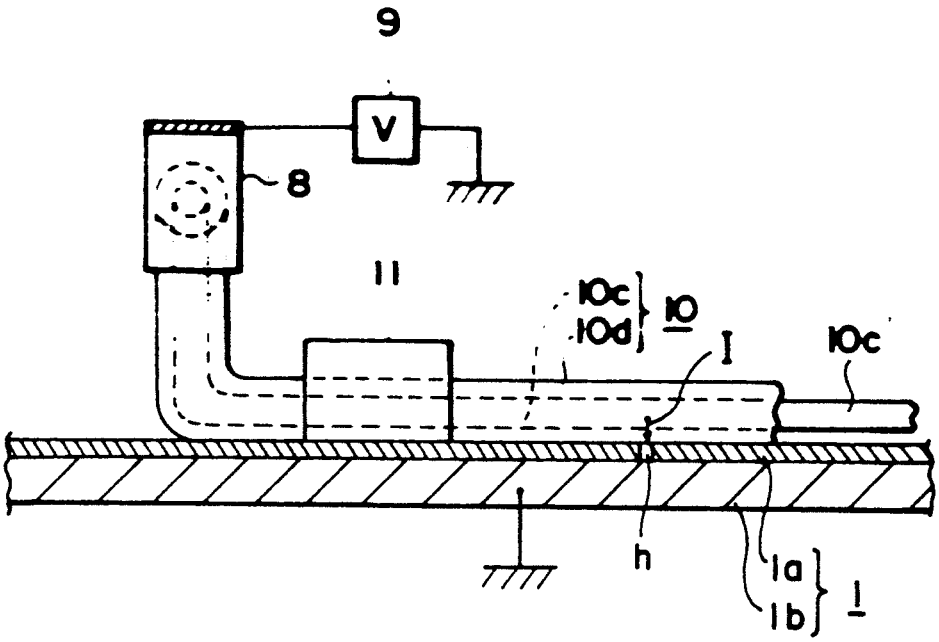

FIG. 21 shows this situation. This Figure is a sectional view when the pin hole h of the photosensitive drum 1 comes right below the bare charging member 10*c* without the coating. As will be understood, if the charging wire 10*c* is of a bare metal such as iron, the electric current I easily flows into the pin hole h along the length of the charging wire 10*c*, in other words, the large current path is produced toward the pin hole h, and therefore, the voltage easily drops.

By coating the charging wire in the manner described above, the volume resistivity of the surface layer of the charging wire is larger than that of the conductive core, and therefore, the current toward the surface defect such as pin hole along the surface layer becomes smaller. Therefore, even if there is the pin hole or other defect, the voltage drop of the power supply system attributable to the leakage can be prevented. Therefore, the improper charging does not occur over the entire contact region between the charging member and the member to be charged. In the case of the image forming apparatus, the above-described degrading of the image quality can be avoided. Without increasing the voltage of the supply system, the sufficient voltage can be supplied, and therefore, the improper charging or non-uniform charging attributable to the insufficient AC voltage, can be prevented. The advantageous effects are particularly significant, when the peak-to-peak voltage of the vibratory voltage is not less than twice the charge starting voltage which is the voltage at which the charging of the member to be charged starts when a DC voltage only is applied.

When the charging member is a bare core metal 10*c* without the surface layer 10*d* is directly contacted to the photosensitive drum, and a voltage is applied to the charging member, the equivalent circuit is as shown in FIG. 24. The resistance r of the core metal 10*c* is substantially 0 ohm. As described hereinbefore, if the photosensitive drum 1 has a pin hole, the voltage leaks with the result of the non-uniform stripe produced along the length of the photosensitive drum 1.

This embodiment, the charging member has the surface layer of a dielectric material on the conductive wire, and the reactance of the charging member relative to the vibratory voltage (AC voltage) is smaller than the resistance of the charging wire. The charging member has the dielectric layer or the surface layer comprising a resistance layer and a dielectric layer at least at a contact portion with the member to be charged, by which the charging member has the electrostatic capacity component or a resistance and electrostatic capacity components. The resistance is sufficiently large so as to prevent the leakage between the charging member and a pin hole of the member to be charged even if the member to be charged (photosensitive drum or the like) has a pin hole due to shot by or introduction of foreign matter. The electrostatic capacity is made sufficiently larger than that of the member to be charged, by which the reactance of the charging member relative to the AC voltage is made sufficiently smaller than the resistance of the charging wire.

As a result, even if the member to be charged as a pin hole, the voltage drop of the power supply system due to the leakage can be prevented, so that the improper charging of the entire range along the length of the charging member where it is contacted to the member to be charged, can be prevented.

Therefore, in the case of the image forming apparatus, the black stripe (reverse development) and white stripe (regular development) which is attributable to the leakage and which appears periodically in accordance with the rotation of the photosensitive drum, can be prevented. And therefore, the degradation of the quality of the image thereby can be prevented.

In addition, without increasing the AC voltage, the sufficient voltage can be applied to the member to be charged. Therefore, the improper or non-uniform charging due to the insufficient AC voltage can be prevented. This advantageous effects are particularly significant when the peak-to-peak voltage of the vibratory voltage applied to the contact type charging wire is not less than twice the charge starting voltage which is the voltage at which the charging of the member to be charged starts when only the DC voltage is applied.

Since the charging wire does not have the charging layer made of rubber or the like as in the case of the charging roller or the charging blade, there is no production of the image flow attributable to the oozed plasticizer of the conductive rubber layer, local improper charging attributable to the rising of the charging member, or the charging noise.

In the embodiment shown in FIGS. 17–19, the wire 10 may be press-contacted to the surface of the drum 1 by an elongated elastic member made of moltprane or the like over the entire length of the charging wire 10, as described hereinbefore. Two or more charging wires may be disposed in parallel with each other.

Figure 25:
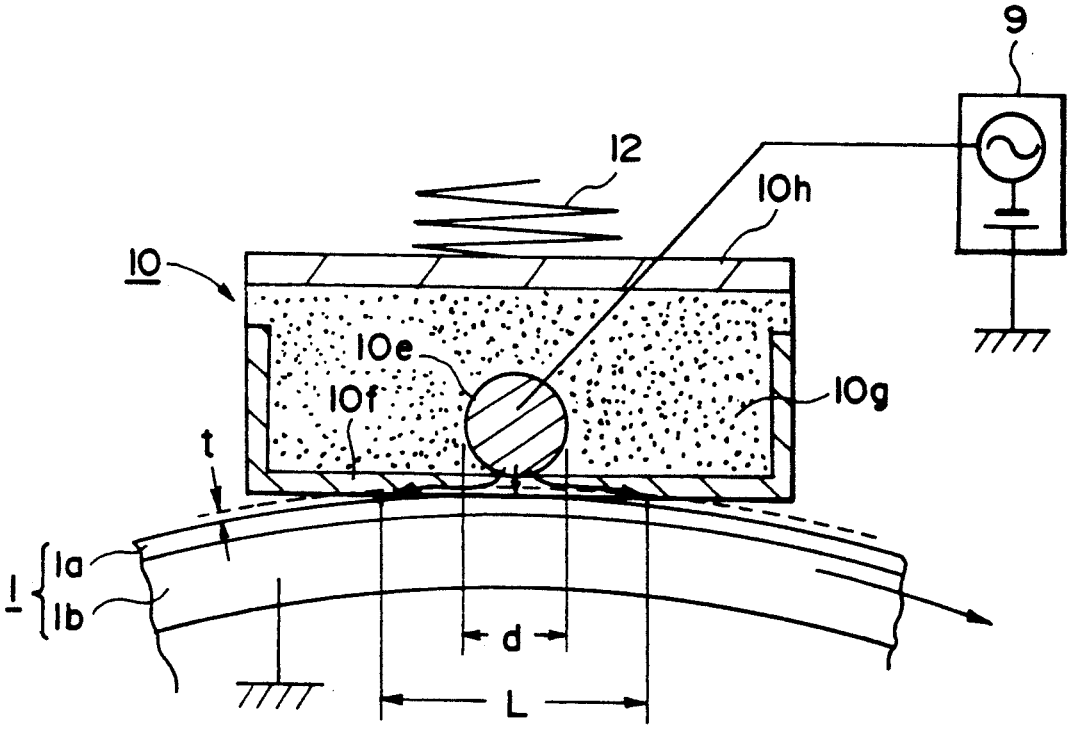

In FIG. 25, the charging member comprises:

conductive wire 10*e* having a diameter d of 60 microns and made of tungsten; and a resistance member 10*f* having a volume resistivity of $10^{10}$ ohm.cm made of fluorinated resin containing carbon (EMLARON (trade name), available from Nippon Ajison Kabushiki Kaisha) and having a thickness of 25 microns.

In the case of this contactable charging member 10, the charging width L was 200 microns when the diameter d of the conductive wire 10*e* was 60 microns.

With the above-structure, the photosensitive drum 1 was rotated at a peripheral speed of 40 mm/sec, and the charging wire 10 was supplied with a vibratory voltage having a DC voltage component of −700 V and an AC voltage component having a peak-to-peak voltage 1800 Vpp and a frequency of 250 Hz. Then, the surface of the photosensitive member 1*a* was uniformly charged approximately to −700 V without improper image due to pin holes or without charging noise or very low charging noise.

In this embodiment, the provision of the elastic member 10 reduces the production of the charging noise.

The flow of the image attributable to the plasticizer oozed out from the conductive rubber layer as in the case of the charging roller or the charging blade, was not observed. In addition, the partial improper charging attributable to the rising of the charging member was not observed.

The advantageous effects of this embodiment is particularly significant when the peak-to-peak voltage of the vibratory voltage is not less than twice the charge starting voltage which is the voltage at which the charging of the member to be charged starts when only a DC voltage is applied.

In this embodiment, the charge starting voltage when only the DC voltage was applied was −560 V.

With decrease of diameter, width or thickness of the wire (conductive member) to which the voltage is applied, that is, with the decrease of the width of the nip between the conductive wire and the member to be charged, the level of the charging noise can be reduced to the practical extent or can be practically eliminated.

With the decrease of the width, the charging width becomes small, and as a result, the resistance of the charging portion becomes large. Then, it becomes more difficult for the current to flow, and therefore, the improper charging action easily occurs.

Figure 26:
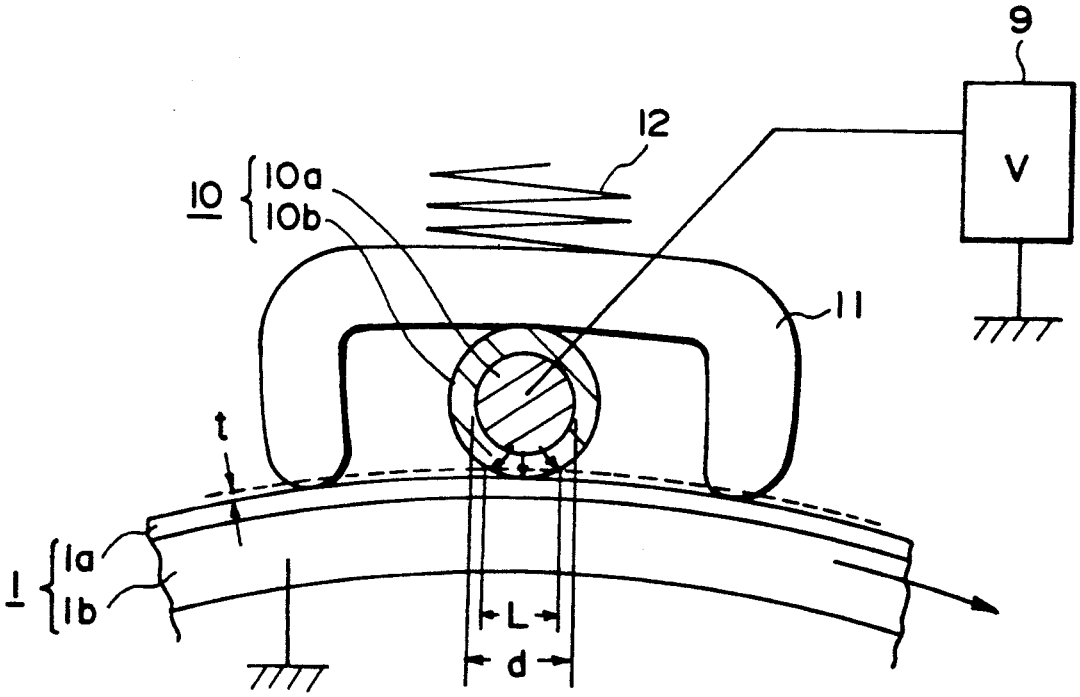

In FIG. 26, the contactable charging member 10 comprises a conductive wire (conductive member) 10*a* having a circular cross-section and a coating 10*b* (resistance material) on the outer periphery of the conductive wire. This is press-contacted to the surface of the photosensitive drum 1 (member to be charged) in the direction substantially parallel to the generating line of the drum by confining members 11 and an urging members 12. A voltage is applied to the conductive wire 10*a* from the voltage source 9 to effect the charging of the photosensitive drum 1. If the width of the area in which the conductive wire 10*a* of the charging member 10 is faced to the photosensitive drum 1 (diameter of the wire 10*a*) is d, and the charging width is L, the charging width L is substantially equal to the contact area between the charging member 10 and the drum 1. The charging width L is smaller than the width d. If the width d is reduced for the purpose of reducing the charging noise, the charging width L decreases with the result of possibility of improper charging.

The charging width L can be determined in the following manner. The photosensitive drum 1 is stopped. A bias voltage is applied to the conductive wire 10*a* from the voltage source 9 for several minutes. Next, the drum 1 is developed with a halftone level and an image is transferred onto the transfer material. Then, on the transfer material, the developed charge memory image is transferred. The width of the charge memory is the charging width L.

A charge limitation t means that if the surface of the charging member 10 is away from the surface of the photosensitive drum 1 by a distance not less than t, the charging is not possible. This is determined by the Passhen's Law. Under the normal ambient condition, it is several tens microns.

Therefore, in this system, the reduction of the width d in order to reduce the produced charging noise has to be made in consideration of maintenance of sufficient charging width L, and therefore, there is a limit.

In this embodiment, the surface of the resistance member contactable to the member to be charged is substantially flat. Therefore, as shown in FIG. 25, the charging width L becomes larger than the width d.

The contactable charging member 10 of FIG. 25 uses a conductive wire having a circular cross-section as the conductive member 10*e*, and the conductive wire is attached to the bottom surface of an elongated elastic member 10*g* made of MOLTOPREN or the like. The bottom side of the elastic material 10*e* having having the wire 10*e* is entirely coated with a high resistance material. The top surface of the elastic material 10*g* opposite from the coating layer 10*f* is mounted to an urging plate 10*h* made of rigid material.

Since the coating layer 10*f* is made of resistance material, and since the surface contactable to the member to be charged 1 is substantially flat, the charging width (contact width) L is larger than the width d with which the conductive wire is faced to the drum.

The coating layer 10*f* side (resistance member) of the contactable charging member 10 is urged to the surface of the photosensitive drum 1 against the elasticity of the elastic member 10*g*, and a voltage is applied to the wire 10*a* to charge the photosensitive drum 1 surface.

In this case, the charging width L increases relative to the width d, and therefore, the width d may be made smaller to sufficiently suppress or substantially eliminate the production of the charging noise, while maintaining the sufficient charging width L. By doing so, the charging operation is stabilized.

Figure 27:
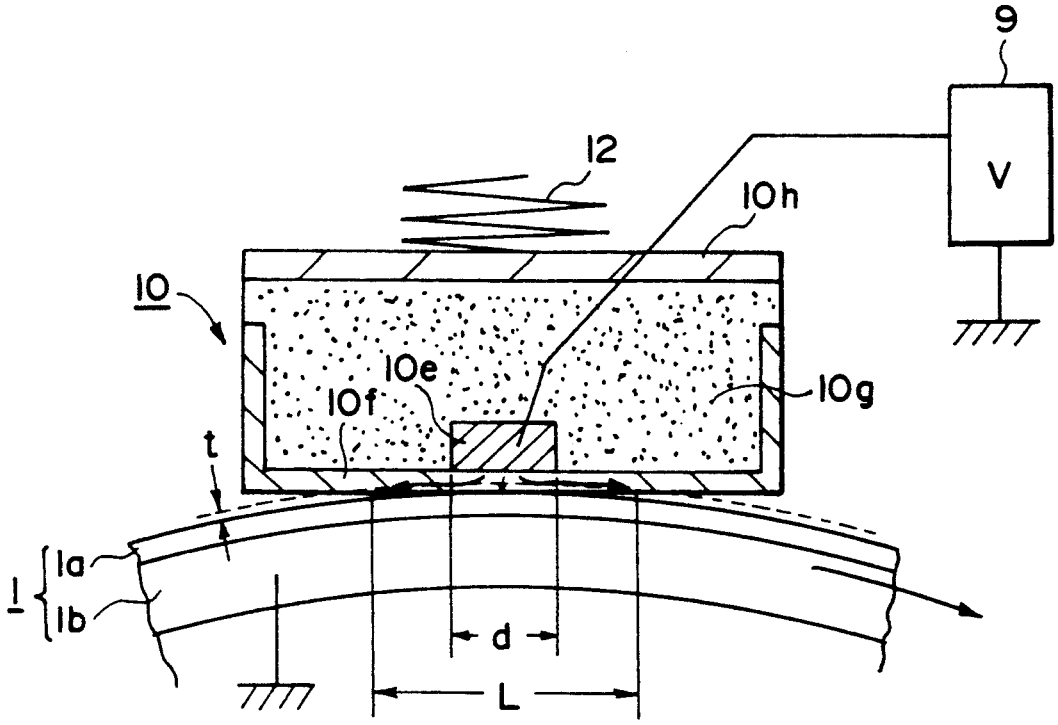

The cross-section of the conductive member 10*e* is not limited to circle, but may be rectangular, as shown in FIG. 27.

In the devices shown in FIGS. 17–19, the following measurements were effected.

The voltage applied to the conductive member 10*a* of the charging wire 10 was a vibratory voltage containing a DC voltage component of −700 V and an AC voltage component having a peak-to-peak voltage of 1800 Vpp and the frequency of 250 Hz. The width d of the conductive member 10*a*, that is, a diameter thereof was changed.

Figure 28:
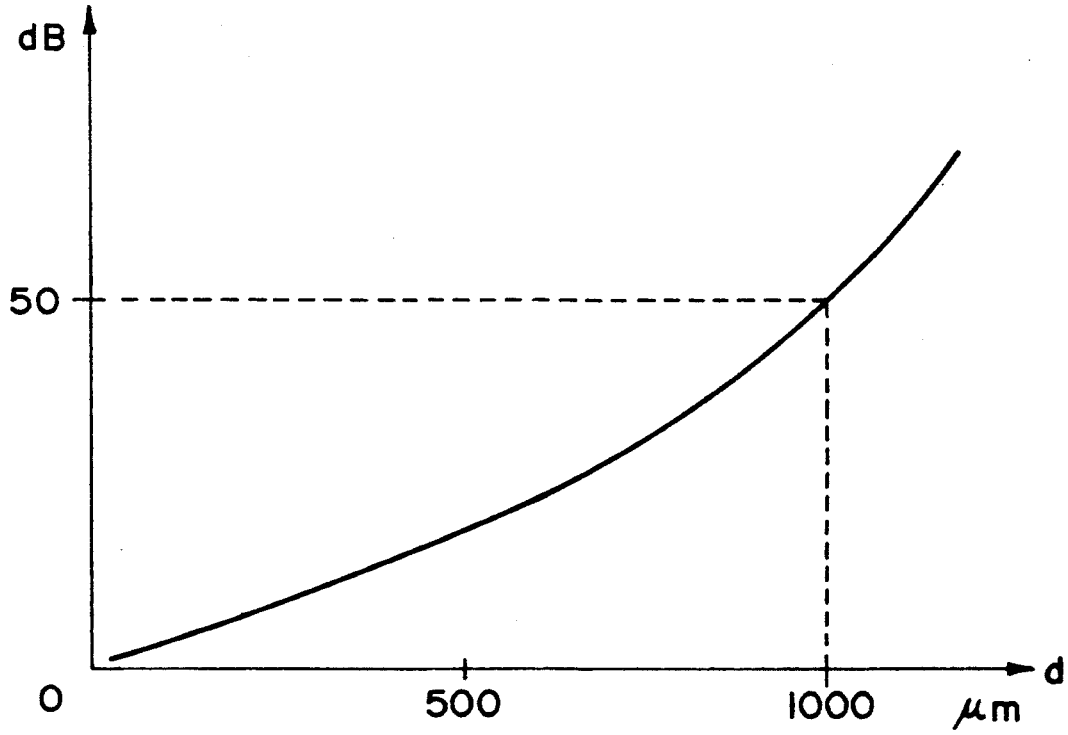
FIG. 28 is a graph of noise relative to the width (diameter) of the conductive member.

FIG. 28 shows the results of measurements of the charging noise. In FIG. 28, the abscissa represents the width (diameter) d of the conductive member, and the ordinate represents the magnitude of the produced noise (dB).

If the width d exceeds 1000 microns, the noise level exceeds 50 dB which is a practical noise limit. This applied to the AC voltage having the peak-to-peak voltage and the frequency usually applied to the charging member.

The reasons are considered as follows. In the case of the contact charging, upon application of the external bias to the contact charging member, the contact charging member starts to vibrate. By the motion of the air sandwiched between the contact charging member and the member to be charged, and the charging noise is produced. When, however, the charging wire 10 is thin as in this embodiment and as contrasted to the conventional contact type charging roller having a large diameter the air sandwiched by the charging member 10 and the member to be charged 1 decreased, and therefore, the noise production is decreased.

If, however, the width d is too small, not more than 4 microns, then the area of the charging portion decreases with the result of increased charging resistance and the improper charging. The output images are deteriorated as shown in the Table below.

TABLE 1

| d μm | 10 | 9 | 8 | 7 | 6 | 5 | 4 | 3 | 2 | 1 |
|---|---|---|---|---|---|---|---|---|---|---|
| Image | G | G | G | G | G | G | N | N | N | N |

G: Good, N: No good

From the foregoing measurements, it has been confirmed that when the member to be charged is charged by a conductive member supplied with a voltage, directly or through a resistance member, the width d of the conductive member faced to the member to be charged can be set so as to satisfy 5 microns $< d <$ 1000 microns, by which the produced charging noise can be within a practically tolerable range.

When a coating layer **10*b* (resistance material) is used on the conductive member 10*a*, the thickness may have something to do with the width d. However, the thickness is generally small, and therefore, it will substantially suffice that the width d of the conductive member 10*a* is determined as described above. Rather, if the coating layer 10*b* is used, the elastic property of the coating layer 10*b*** reduces the charging noise.

As shown in FIGS. 6–8, where plural charging wires are used, the charging noise produced by the charging wires can be reduced by confining the width d of each of the conductive members of the charging wires **10*a* and 10*b***. However, it would be possible that the total noise would be large, and therefore it is desirable that the sum of the conductive members of the charging wires is within the above-described range.

Figure 29A:
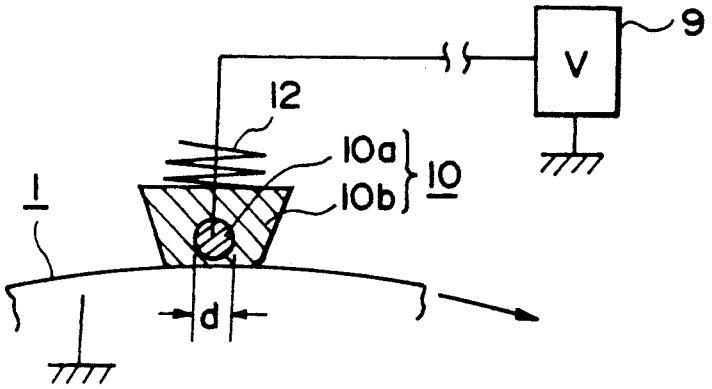
Figure 29B:
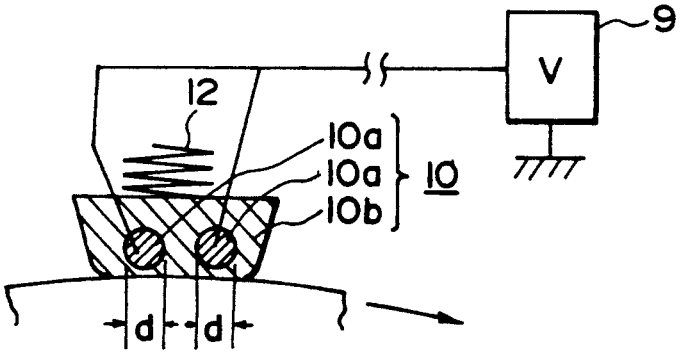

As shown in FIG. 29A or FIG. 29B, the contact type charging member 10 may be in the form of an integral molded member comprising one or more conductive members **10*a* and a resistance member 10*b*, wherein the conductive member or members embedded in the thickness of the resistance member 10*b***. This is suitable for mass-production, and therefore, the cost can be decreased.

Figure 9A:
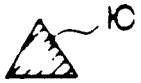
FIGS. 9A, 9B, 9C, 9D, 9E, 9F, 9G, 9H, 9I and 9K are sectional views of the charging wire.
Figure 9B:
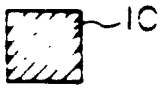
Figure 9C:
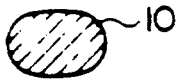
Figure 9D:
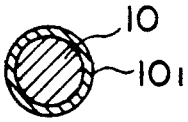
Figure 9E:
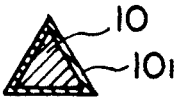
Figure 9F:
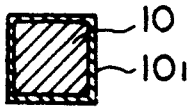
Figure 9G:
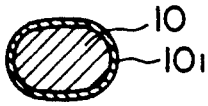
Figure 9H:
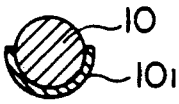
Figure 9I:
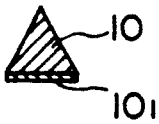
Figure 9J:
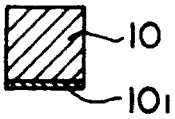
Figure 9K:
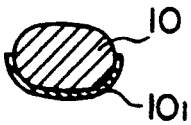

As described in the foregoing, the cross-section of the charging wire 10 is not necessarily circular, but may be triangular, rectangular, oval or the like, as shown in FIGS. 9A, 9B and 9C. In these cases, the contact area between the photosensitive drum and the charging wire can be larger, and therefore, as compared with the circular charging wire, the stabilized charging becomes possible.

As shown in FIGS. 9D, 9E, 9F and 9G, the outer periphery of the core metal of the charging wire 10 may be coated with dielectric surface layer $\mathbf{10}_1$ made of resin or the like (the thickness is 10–1000 microns, for example). Or, as shown in FIGS. 9H, 9I, 9J and 9K, the surface layer $\mathbf{10}_1$ may be formed at least at the contact portion with the member to be charged.

Usable materials for the surface layer $\mathbf{10}_1$ includes n-methoxymethyl nylon (Toresin (trade name), available from Teikoku Kagaku Sangyo Kabushiki Kaisha, Japan), polyvinyl butyral resin material, polyurethane resin material, ethylenevinyl acetate resin, styrene butadiene resin material, fluorinated resin material in which low resistance powder (carbon or the like) is dispersed (EMLARON (trade name), available from Nihon Agison Kabushiki Kaisha), reproduced cellulose. As described hereinbefore, if the rubber is not used, it is preferable because of no liability of the plasticizer attaching to the photosensitive member. However, in order simply to prevent the leakage, the usable material includes epychlorohydrine, urethane, Cr, NBR rubber or the like. In this case, it is preferable that the resin layer is provided on the side where the charging member is contacted to the photosensitive member. It is possible that heat-shrinking tube.

The resin layer may comprise two or more layers.

Among the above-described embodiments, if the charging member contacting the member to be charged is in the form of a wire (outer diameter of 5–1000 microns), the silica particles or the toner particles having passed under the cleaning device 6 are easily passed on the wire of the charging member, as contrasted to the case of the charging blade. Therefore, they are not so easily deposited on the charging wire.

In the foregoing, the vibratory voltage applied between the charging member and the photosensitive member contains the voltage provided by periodically rendering a DC voltage on and off into a rectangular wave voltage.

The foregoing embodiments apply to the case of decreasing the electric potential of the member to be charged (discharging) as well as increasing the potential of the member to be charged.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member; and charging means extending in contact with said image bearing member in a direction crossing with a movement direction of said image bearing member, said charging means including a conductive wire extending in the crossing direction;

wherein said conductive wire, measured along the movement direction of said image bearing member, is more than 5 microns and less than 100 microns.

2. An apparatus according to claim 1, further comprising means for applying a voltage between said conductive wire and said image bearing member to electrically charge said image bearing member.

3. An apparatus according to claim 2, wherein the voltage has a periodically changing voltage level.

4. An apparatus according to claim 3, wherein the voltage has a peak-to-peak voltage which is not less than twice a charge starting voltage of said charging means relative to said image bearing member.

5. An apparatus according to claim 1, wherein said charging means includes a dielectric layer contactable to said image bearing member.

6. An apparatus according to claim 5, wherein said dielectric layer is of resin material.

7. An apparatus according to claim 6, wherein said resin material is non-rubber resin material.

8. An apparatus according to claim 3 or 4, wherein said charging means has a dielectric layer contactable to said image bearing member, and wherein a reactance of said charging means relative to a voltage of said charging means is smaller than a resistance of said charging means.

9. An apparatus according to claim 8, wherein an electrostatic capacity of said charging means is larger than that of said image bearing member.

10. An apparatus according to claim 1, further comprising supporting means for supporting said charging means.

11. An apparatus according to claim 10, wherein said supporting means extends in the crossing direction to urge said charging means to said image bearing member over a length in the crossing direction.

12. An apparatus according to claim 1, wherein a charging width measured in a direction of movement of a surface of image bearing member is larger than a width of said conductive wire measured in the same direction.

13. An apparatus according to claim 1, wherein said charging means is operated when a latent image is formed on said image bearing member.

14. An apparatus according to claim 6 or 7, wherein said dielectric layer is made of n-methoxymethyl nylon, polyvinyl butyral resin material, polyurethane resin material, ethylene vinyl acetate resin material, styrene butadiene resin material, fluorinated resin material in which low resistance powder is dispersed, or regenerated cellulose.

15. An apparatus according to claim 1, wherein said image bearing member is an organic photoconductor material.

16. An apparatus according to claim 1, further comprising a process unit detachably mountable to said apparatus and containing said image bearing member and said charging means.

17. A process unit detachably mountable to an image forming apparatus, comprising:

a movable image bearing member; and a charging means extending in contact with said image bearing member in a direction crossing with a movement direction of said image bearing member, said charging means including a conductive wire extending in the crossing direction;

wherein said conductive wire, measured along the movement direction of said image bearing member, is more than 5 microns and less than 1000 microns.

18. A process unit according to claim 17, wherein said charging means includes a dielectric layer contactable to said image bearing member.

19. A process unit according to claim 18, wherein said dielectric layer is of resin material.

20. A process unit according to claim 19, wherein said resin material is non-rubber resin material.

21. A process unit according to claim 17, wherein an electrostatic capacity of said charging means is larger than that of said image bearing member.

22. A process unit according to claim 17, further comprising supporting means for supporting said charging means.

23. A process unit according to claim 22, wherein said supporting means extends in the crossing direction to urge said charging means to said image bearing member over a length in the crossing direction.

24. A process unit according to claim 17, wherein a charging width measured in a direction of movement of a surface of said image bearing member is larger than a width of said conductive wire measured in the same direction.

25. A process unit according to claim 17, wherein said charging means is operated when a latent image is formed on said image bearing member.

26. A process unit according to claim 19 or 20, wherein said dielectric layer is made of n-methoxymethyl nylon, polyvinyl butyral resin material, polyurethane resin material, ethylene vinyl acetate resin material, styrene butadiene resin material, fluorinated resin material in which low resistance powder is dispersed, or regenerated cellulose.

27. A process unit according to claim 17, wherein said image bearing member is an organic photoconductor material.

28. An image forming apparatus, comprising:

a movable image bearing member; and a charging wire extending in contact with said image bearing member in a direction crossing with a movement direction of said image bearing member, said charging wire including a conductive wire;

wherein said conductive wire, measured along the movement direction of said image bearing member, is more than 5 microns and less than 1000 microns.

29. An apparatus according to claim 28, further comprising means for applying a voltage between said conductive wire and said image bearing member to electrically charge said image bearing member.

30. An apparatus according to claim 28, wherein the voltage has a periodically changing voltage level.

31. An apparatus according to claim 30, wherein the voltage has a peak-to-peak voltage which is not less than twice a charge starting voltage of said charging wire relative to said image bearing member.

32. An apparatus according to claim 28, wherein said charging wire includes a dielectric layer contactable to said image bearing member.

33. An apparatus according to claim 32, wherein said dielectric layer is of resin material.

34. An apparatus according to claim 33, wherein said resin material is non-rubber resin material.

35. An apparatus according to claim 30 or 31, wherein said charging wire has a dielectric layer contactable to said image bearing member, and wherein a reactance of said charging wire relative to a voltage of said charging wire is smaller than a resistance of said charging wire.

36. An apparatus according to claim 35, wherein an electrostatic capacity of said charging wire is larger than that of said image bearing member.

37. An apparatus according to claim 28, further comprising supporting means for supporting said charging wire.

38. An apparatus according to claim 37, wherein said supporting means extends in the crossing direction to urge said charging wire to said image bearing member over a length in the crossing direction.

39. An apparatus according to claim 28, wherein a charging width measured in a direction of movement of a surface of said image bearing member is larger than a width of said conductive wire measured in the same direction.

40. An apparatus according to claim 28, wherein said charging wire is operated when a latent image is formed on said image bearing member.

41. An apparatus according to claim 34, wherein said dielectric layer is made of n-methoxymethyl nylon, polyvinyl butyral resin material, polyurethane resin material, ethylene vinyl acetate resin material, styrene butadiene resin material, fluorinated resin material in which low resistance powder is dispersed, or regenerated cellulose.

42. An apparatus according to claim 28, wherein said image bearing member is an organic photoconductor material.

43. An apparatus according to claim 28, further comprising a process unit detachably mountable to said apparatus and containing said image bearing member and said charging wire.

44. A process unit detachably mountable to an image forming apparatus, comprising:

a movable image bearing member; and a charging wire contactable to said image bearing member and extending in a direction crossing with a movement direction of said image bearing member to electrically charge said image bearing member, said charging wire including a conductive wire;

wherein said conductive wire, measured along the movement direction of said image bearing member, is more than 5 microns and less than 1000 microns.

45. An image forming apparatus, comprising:

a movable image bearing member; and charging means extending in contact with said image bearing member in a direction crossing with a movement direction of said image bearing member, said charging means including an electrode extending in the crossing direction;

wherein said electrode, measured along the movement direction of said image bearing member, is more than 5 microns and less than 1000 microns.

46. An apparatus according to claim 45, wherein said charging means includes a dielectric layer contactable to said image bearing member.

47. An apparatus according to claim 46, wherein said dielectric layer is of resin material.

48. An apparatus according to claim 47, wherein said resin material is non-rubber resin material.

49. An apparatus according to claim 45, wherein a charging width measured in a direction of movement of a surface of said image bearing member is larger than a width of said electrode measured in the same direction.

50. A process unit detachably mountable to an image forming apparatus, comprising:

a movable image bearing member; and charging means extending in contact with said image bearing member in a direction crossing with a movement direction of said image bearing member, said charging means including an electrode extending in the crossing direction;

wherein said electrode, measured along the movement direction of said image bearing member, is more than 5 microns and less than 1000 microns.

51. An apparatus according to claim 1, wherein said charging means contacts said image bearing member within a range in the movement direction which is larger than the width of the charging wire.

52. A process unit according to claim 17, wherein said charging means contacts said image bearing member within a range in the movement direction which is larger than the width of the charging wire.

53. An apparatus according to claim 45, wherein said charging means contacts said image bearing member within a range in the movement direction which is larger than the width of the electrode.

54. A process unit according to claim 50, wherein said charging means contacts said image bearing member within a range in the movement direction which is larger than the width of the electrode.

55. An apparatus according to claim 1 or 28, wherein said charging wire has a volume resistivity of substantially 0 Ohm.cm.

56. A process unit according to claim 17 or 44, wherein said charging wire has a volume resistivity of substantially 0 Ohm.cm.

57. An apparatus according to claim 45, wherein said electrode has a volume resistivity of substantially 0 Ohm.cm.

58. A process unit according to claim 50, wherein said electrode has a volume resistivity of substantially 0 Ohm.cm.

* * * * *

UNITED STATES PATENT AND TRADEMARK OFFICE

CERTIFICATE OF CORRECTION

PATENT NO. : 5,177,534

DATED : January 5, 1993

INVENTOR(S) : HIROKI KISU, et al.

It is certified that error appears in the above-indentified patent and that said Letters Patent is hereby corrected as shown below:

COLUMN 2

Line 44, "(FIG.10)" should -- (FIG. 10) --.

COLUMN 4

Line 56, "Springs," should read -- Springs --.

COLUMN 5

Line 57, "(AVAILABLE" should read -- (available --.

COLUMN 6

Line 19, "members 14," should read -- member 14, --.

COLUMN 7

Line 66, "R>½πfC" should read -- R>>½πfC --;
Line 68, "C>Cd" should read -- C>>Cd --.

COLUMN 8

Line 53, "t" should read -- to --;
Line 55, "π1," should read -- P1, --;
Line 56, "π2," should read -- P2, --;
Line 67, "R1=(π2x1nr2/r1)/Ld" should read -- R1=(P2x1nr2/r1)/Ld --.

COLUMN 9

Line 1, "π2" should read -- P2 --.

Signed and Sealed this

Eighth Day of March, 1994

Bruce Lehman

BRUCE LEHMAN

*Commissioner of Patents and Trademarks*

*Attest:*

*Attesting Officer*